United States Patent [19]

McCabe et al.

[11] 4,160,666

[45] Jul. 10, 1979

[54] POLYMERIC CHEMICAL SENSITIZERS FOR ORGANIC PHOTOCONDUCTIVE COMPOSITIONS

[75] Inventors: John M. McCabe; William E. Yoerger, both of Rochester, N.Y.

[73] Assignee: Eastman Kodak Company, Rochester, N.Y.

[21] Appl. No.: 800,594

[22] Filed: May 25, 1977

[51] Int. Cl.[2] ..... G03G 5/06; G03G 5/09

[52] U.S. Cl. ..... 96/1 PC; 96/1.5 R; 96/1.6; 525/59

[58] Field of Search ..... 96/1.5, 1.6, 1.7, 1 PC; 260/78.4 D

[56] References Cited

U.S. PATENT DOCUMENTS

| | | | |
|---|---|---|---|
| 3,552,959 | 1/1971 | Yamaguchi et al. | 96/1.6 |
| 3,554,747 | 1/1971 | Dastoor | 96/1.8 |
| 3,738,970 | 6/1973 | Cimino et al. | 260/78.4 D |

FOREIGN PATENT DOCUMENTS

| | | | |
|---|---|---|---|
| 847807 | 7/1970 | Canada | 96/1.3 |
| 915959 | 12/1972 | Canada | 96/1.3 |

*Primary Examiner*—Roland E. Martin, Jr.

*Assistant Examiner*—John L. Goodrow

*Attorney, Agent, or Firm*—T. N. Dahl

[57] ABSTRACT

Photoconductive insulating compositions comprising organic photoconductors are described. Organic photoconductor materials such as p-terphenyl or polyvinylcarbazole are dispersed or dissolved in an electrically insulating binder and chemically sensitized with a polymer having repeating units to which are appended a monovalent chlorendate radical. When employing the aforesaid polymeric chemical sensitizer, acrylic polymers or cellulose nitrates are especially useful as insulating binders for heterogeneous compositions of the subject type. Or, by omitting conventional binders, the described polymeric chemical sensitizer can function simultaneously as chemical sensitizer and insulating binder for such photoconductive compositions. Further, the present polymeric chemical sensitizer is particularly useful with one or more additional chemical sensitizers to yield sensitized compositions with especially desirable properties.

Compositions comprising the polymeric chemical sensitizers of this invention are applied to an electrically conducting support to prepare electrophotographic elements.

38 Claims, No Drawings

POLYMERIC CHEMICAL SENSITIZERS FOR ORGANIC PHOTOCONDUCTIVE COMPOSITIONS

BACKGROUND OF THE INVENTION

1. Field of the Invention

This invention relates to electrophotography. More particularly, it relates to chemical sensitization of photoconductive compositions and electrophotographic elements with chemical sensitizing polymers comprising repeating units containing highly chlorinated monovalent pendant radicals.

2. Discussion of Related Art

The process of xerography, as disclosed by Carlson in U.S. Pat. No. 2,297,691 (issued Oct. 6, 1942), employs an electrophotographic element comprising a support material bearing a coating of a normally insulating material whose electrical resistance varies with the amount of incident electromagnetic radiation it receives during an imagewise exposure. The element, commonly termed a photoconductive element, is first given a uniform surface charge, generally in the dark after a suitable period of dark adaptation. It is then exposed to a pattern of actinic radiation which has the effect of differentially reducing the potential of this surface charge in accordance with the relative energy contained in various parts of the radiation pattern. The differential surface charge or electrostatic latent image remaining on the electrophotographic element is then made visible by contacting the surface with a suitable electroscopic marking material. Such marking material or toner whether contained in an insulating liquid or on a dry carrier, can be deposited on the exposed surface in accordance with either the charge pattern or discharge pattern as desired. Deposited marking material can then be either permanently fixed to the surface of the sensitive element by known means such as heat, pressure, solvent vapor, or the like, or transferred to a second element to which it can similarly be fixed. Likewise, the electrostatic latent image can be transferred to a second element and developed there.

Various photoconductive insulating materials have been employed in the manufacture of electrophotographic elements. For example, vapors of selenium and vapors of selenium alloys deposited on a suitable support, and particles of photoconductive zinc oxide dispersed in resinous, film-forming binder have found wide application in the present-day document copying applications. For example, in the photoconductive compositions of U.S. Pat. No. 3,008,825 (issued Nov. 14, 1961 to W. G. Van Dorn et al), inorganic photoconductors are dispersed in such binders as polymerized butyl methacrylates, or vinyl polymers such as polymers of styrene, vinyl chloride, vinyl acetate, and the like. In dispersing inorganic photoconductors in acrylic polymer binders, the technical literature indicates that it is preferred to employ acrylic terpolymers and acrylic polymers free of acid groups, owing to the lowering of light sensitivity when either acrylic homopolymers, acrylic copolymers, or acrylic polymers containing acid groups are employed. (See *Photographic Science and Engineering*, Volume 16, No. 5, September-October 1972, pp. 354–358, and in particular, pp. 355–357).

Since the introduction of electrophotography, a great many organic compounds have also been screened for their photoconductive properties. As a result, a very large number of organic compounds have been shown to possess some degree of photoconductivity. Many organic compounds have revealed a useful level of photoconductivity and have been incorporated into photoconductive compositions.

In photoconductive insulating compositions using organic photoconductors, the photoconductor, if not polymeric, is usually carried in a film-forming binder. Typical binders are polymeric materials having fairly high dielectric strength such as phenolic resins, ketone resins, acrylic ester resins, polystyrenes and the like. A more comprehensive listing of binders appears in U.S. Pat. No. 3,755,310 (issued Aug. 28, 1973 to L. J. Rossi). The photoconductor can be dissolved with the binder to prepare a homogeneous photoconductive composition in a common solvent. In another aspect, it can be provided as a dispersion of small particles in the binder to prepare a heterogeneous phtoocnductive composition. A general discussion of such dispersions and their preparation appears in U.S. Pat. No. 3,253,914 (issued May 31, 1966 to G. Schaum et al).

Organic photoconductors demonstrate widely varying degrees of solubility in the organic solvents used to dissolve many of the common binders. In the preparation of homogeneous photoconductive insulating compositions, organic photoconductors such as p-terphenyl and others of low solubility in popular solvents cannot usually be included in sufficient concentration to provide compositions of desirable light-sensitivity. By use of dispersion techniques such as those referred to in the case of zinc oxide photoconductors, heterogeneous photoconductive insulating compositions having higher concentrations of low solubility photoconductors can be obtained, the objective being to improve light-sensitivity in the composition.

Heterogeneous organic photoconductive compositions as discussed herein can be advantageous, especially in the preparation of electrophotographic elements on which visible images will be provided. For example, such elements are both lighter in weight than elements having inorganic photoconductors like zinc oxide, and can be prepared to resemble bond paper. However, they have not enjoyed in such applications the popularity of photoconductive insulating compositions comprising inorganic photoconductors. This is largely due to the unacceptable photoconductivity of heterogeneous compositions of organic photoconductors, despite high concentrations of photoconductor.

To improve the photoconductivity of photoconductive compositions having organic photoconductors, a variety of compounds and polymers have been studied for use as so-called chemical sensitizers or activators. When added to photoconductive compositions it is intended that such materials enhance the photoconductivity of the composition at least within the electromagnetic wavelength region in which the composition is intrinsically sensitive. If successful, the composition is said to be chemically sensitized or activated. It should be pointed out, however, that chemical sensitizers are oftentimes specific in their utility. That is, they may have utility in homogeneous systems or heterogeneous systems but not generally in both. Materials which do serve as sensitizers for both systems, accordingly, are rare and highly desirable.

In copending application U.S. Ser. No. 800,483, now U.S. Pat. No. 4,082,550 entitled HEXACHLOROCYCLOPENTENE CHEMICAL SENSITIZERS FOR HETEROGENEOUS ORGANIC PHOTOCONDUCTIVE COMPOSITIONS in the name of William E. Yoerger filed concurrently herewith, an invention is described wherein certain highly chlorinated compounds, in particular monomeric hexachlorocyclopentenes, are highly useful as chemical sensitizers for photoconductive compositions having cellulose nitrate as binder for dispersed organic photoconductors. The success of such monomeric sensitizers in photoconductive compositions is in part attributable to the presence of cellulose nitrate binder. As further pointed out in the aforementioned copending application, choice of binder in a heterogeneous photoconductive composition having dispersed organic photoconductor can affect the ability of the composition to be sensitized. In the case of acrylic polymer binder, this is especially true. Despite references in the prior art to compositions comprising polymers including acrylics as binders for dispersed organic photoconductors (see for example, British Pat. No. 1,431,943 published Apr. 14, 1976 and issued to the Dow Chemical Company) attempts to improve the photoconductivity of such compositions with known chemical sensitizers have been largely unsuccessful. This is unfortunate as acrylic polymers offer especially good hardness, a desirable characteristic in electrophotographic elements.

Selection of a proper chemical sensitizer is further complicated by other requirements of an electrophotographic process. An element employing a chemically sensitized photoconductive composition as defined herein must, for example, readily accept and hold electrostatic charge before imagewise illumination. Many compositions employing materials screened for use as sensitizers, although acceptably photoconductive, undesirably fail to accept a high enough charge to merit further study. Compositions so failing are said to be "charge saturated. Further, though able to accept charge, compositions may be unable to retain that applied charge for reasonable periods of time in the dark, hence the term "dark decay."

SUMMARY OF THE INVENTION

In accordance with the invention, certain polymers serve as chemical sensitizers for photoconductive compositions comprising an organic photoconductor in an electrically insulating binder. Polymeric chemical sensitizers of the invention comprise repeating units to which are appended a monovalent chlorendate radical. Preferred polymeric sensitizers comprise vinyl, acrylic, or cellulose polymer backbones with the described monovalent side chains.

Provision of chemical sensitizers in polymeric form as defined herein is particularly advantageous in several respects. For example, such sensitizers are effective as such for both homogeneous and heterogeneous photoconductive compositions. Furthermore, while monomeric compounds similar to the present chlorendate radical have exhibited binder dependence in their ability to chemically sensitizer heterogeneous organic photoconductive compositions, the polymers of this invention containing monovalent chlorendate radicals are not so limited. Thus, such polymers as vinyl, acrylic, or cellulosic polymers containing monovalent chlorendate radicals can be highly useful as chemical sensitizers without attendant binder dependence. Hence, a wider variety of binder materials is made available. As the invention further evidences, the present polymeric chemical sensitizers can also function simultaneously as binders for heterogeneous photoconductive compositions as defined above.

In a preferred embodiment of the invention, heterogeneous organic photoconductive compositions comprising acrylic binders, though normally unsensitized by compounds such as chlorendic anhydride, are chemically sensitized with notable success employing the present polymeric sensitizers. In this regard, particularly useful compositions are those comprising acrylic homopolymers, copolymers, or acrylic polymers having acid groups, in contrast to the inferior results reported to occur in the use of these types of acrylic binder with dispersed inorganic photoconductors.

In yet another embodiment of the invention, presence of the polymeric chemical sensitizers of this invention in a heterogeneous organic photoconductive composition permits the use of one or more additional chemical sensitizers, especially those noted to be otherwise binder dependent. The resulting composition exhibits both increased photoconductivity and, in certain instances, increased viscosity which stabilizes the heterogeneous composition against settling of the photoconductor particles.

DETAILED DESCRIPTION OF THE PREFERRED EMBODIMENTS

Photoconductive insulating compositions having an organic photoconductor dispersed or dissolved in an electrically insulating binder, are chemically sensitized in accordance with the invention in the presence of a polymer comprising repeating units to which are appended a monovalent chlorendate radical.

The present polymeric sensitizers offer significant latitude in the preparation of electrophotographic elements, especially elements of the type resembling plain paper (both in feel and appearance). In one sense, for example, these polymeric sensitizers raise the photoconductivity of the defined organic photoconductive compositions to a level comparable to that of compositions employing, for example, inorganic photoconductors. This is accomplished without attendant disadvantages, such as excessive weight, glossiness, "coining" propensity etc., typically encountered with inorganic photoconductors. The sensitizing ability of the present polymers, moreover, is relatively independent of the binder selected for use in the photoconductive compositions in accordance with the invention. Hence the use of such tough, resinous materials as acrylic polymers is made possible. In yet another advantageous aspect of the invention, the present polymeric sensitizers can replace conventional binders and become, in effect, binder-sensitizers for organic photoconductors.

The advantages offered by the invention appear to stem from the presence of a chlorendate monovalent radical on repeating units of a polymer backbone, preferably vinyl or cellulose repeating units. As the examples hereinafter point out, chemical sensitization provided by the present polymers is to be contrasted with sensitization provided by monomeric chlorendate compounds, the latter sensitization being, in the main, dependent on the presence of particular binders, such as cellulose nitrate. The abrupt and unexpected transition from non-sensitizing to sensitizing ability in going from a monomeric compound to a polymer having monovalent side radicals based on such compound has been observed with other materials. For example, the compound tetrachlorophthalic anhydride, a known chemical sensitizer for homogeneous electrophotographic compositions, appears to exhibit virtually no sensitization in heterogeneous photoconductive compositions (see example 52 herein). When grafted onto a polyvinylalcohol backbone, useful chemical sensitization is attained. This behavior is true of the monovalent chlorendate radicals of the present invention both in heterogeneous photoconductive compositions (see example 52) and homogeneous photoconductive compositions (see example 61).

Monovalent chlorendate radicals referred to herein can be structurally depicted as:

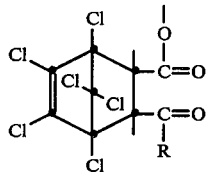

where R can be, for example, substituted or unsubstituted alkyl, amino; hydroxyl; alkoxy; halogen or other such groups.

Preferably R is hydroxyl.

Polymeric sensitizers in accordance with the invention can be made by well-known techniques, the objective being to attach the above monovalent chlorendate radicals to repeating units of an appropriate backbone. Grafting the radicals onto the backbone at reactive sites, for example, through alcoholic hydroxyl groups pendant to a polyvinylalcohol backbone as detailed in U.S. Pat. No. 3,738,970 (issued June 12, 1973 to D. J. Cimino et al) is a particularly useful technique. Furthermore, whether the desired side chain radicals are attached to a preformed polymer backbone, or to a monomeric unit thereof which is subsequently polymerized, is believed to be of no significant distinction — either choice would give the results of the invention.

Typically, the desired radicals are appended to a polymer backbone by esterification of the anhydride, acid chloride, ester, acid or the like of a chlorendate with a reactive hydroxyl on repeating units of the polymer backbone (or monomeric precursor).

Any of a wide variety of polymeric backbones can be employed in the invention provided the desired radicals can be appended thereto. Backbones with vinyl alcohol repeating units, such as polyvinylalcohol, are especially preferred. Other suitable polymers are acrylics including polyacrylates produced by the esterification of a polyhydroxy alcohol with a polyacrylic acid (or monomeric precursor of such polyacid). An exemplary polyacrylate is the polymeric reaction product of ethylene glycol with polymethacrylic acid. The resulting poly(2-hydroxyethylmethacrylate), presents reactive hydroxyl groups which can participate in the esterification of chlorendate compounds in accordance with the invention. This, of course, points out that the proximity of the appended chlorendate groups to the polymer backbone can vary widely. That is, the desired groups may either be close to the backbone or removed therefrom by intervening groups, for example, by from 1 to 10 carbon atoms, preferably from 2 to 4 carbon atoms. Cellulosic polymer backbones can also be employed in the invention as they typically offer reactive hydroxyl sites to participate in the attachment of the desired chlorendate radicals (a cellulose repeating unit having one primary and two secondary hydroxyl groups). Other polymer backbones can also be employed whose repeating units can accept the attachment of the desired radicals.

The term "polymeric" as employed in defining the chemical sensitizers of the invention, includes homopolymers of monomers having the desired groups branching therefrom, as well as copolymers of such monomers with one or more other monomers. In the case of vinyl materials, for example, the polymeric sensitizer can be polyvinylchlorendate or poly(vinylchlorendate-co-vinylacetate). In the case of acrylic polymers, a broad range of choice is contemplated to include such materials as homopolymers of 2-methacryloyloxyethylchlorendate or copolymers thereof with other acrylics such as methacrylic acid, methacrylates and the like. Generally, acrylic or vinyl monomers having the desired appended radicals can be polymerized quite readily by addition polymerization with other monomers containing a polymerizable vinyl group.

Of particular significance in the practice of the invention is the use of the present polymeric sensitizers simultaneously as electrically insulating binders for a photoconductive composition having organic photoconductor materials dispersed or dissolved therein.

While it appears that the broad scope of chemical sensitization of photoconductive compositions disclosed herein is attributable to the polymeric nature of the chemical sensitizers of the invention, the degree of such sensitization is predominantly a function of the amount of chlorendate monovalent radicals present in the polymers. Amount is usually expressed as either percent of such radicals or — if the degree of substitution of such radicals is known — percent polymeric sensitizer, by weight of organic photoconductor. Generally, in compositions of the subject type the present polymers can be employed in an amount from about 0.5% to about 10%, by weight, of the photoconductor. An amount from about 1% to about 3% is preferred. It can be readily appreciated, of course, that as the indicated degree of substitution on the polymer backbone decreases, proportionately higher amounts of polymer are necessary for equivalent degrees of sensitization vis-a-vis fully substituted polymers.

If the polymers of this invention, on the other hand, are employed simultaneously as binder as noted above, the amount of polymer employed can be, of course, greater. In this respect, anywhere from about 5 percent to about 40 percent polymeric chemical sensitizer, by weight based on photoconductor plus polymeric chemical sensitizer, can be used. Preferably, about 20 percent polymeric chemical sensitizer is employed.

The physical properties of the polymeric sensitizers described above can vary widely depending on how they are used. The inherent viscosity of 0.25 gram samples of the present sensitizers in 100 cc of acetone at 25° C. can range from about 0.1 to about 1.0. Preferably the inherent viscosity of the polymers of this invention is in the range from about 0.1 to 0.65.

The present polymeric sensitizers are advantageous in yet another aspect. It has been said that the operability of compounds as chemical sensitizers is frequently dependent on the presence of a particular binder in heterogeneous compositions. However, in the presence of sensitizing polymers of the invention, compounds that are otherwise binder dependent, can contribute — often synergistically — to the photoconductivity of their respective compositions (see examples 53 to 59 below). Therefore, a further embodiment of the invention includes the use of the present polymeric sensitizers in combination with one or more additional chemical sensitizers, particularly those noted to be otherwise binder dependent, in heterogeneous photoconductive compositions defined herein. Suitable additional chemical sensitizers can include $\pi$-deficient N-heteroaromatic compounds such as quinoxalines, halogenated quinoxalines and the like as disclosed in copending application U.S. Ser. No. 800,587 entitled $\pi$-DEFICIENT N-HETEROAROMATIC CHEMICAL SENSITIZERS FOR HETEROGENEOUS ORGANIC PHOTOCONDUCTOR COMPOSITIONS in the name of William E. Yoerger filed concurrently herewith; and other materials known in the art to be useful as chemical sensitizers for photoconductive compositions comprising organic photoconductors.

Especially preferred additional chemical sensitizers are sulfonated naphthalene bis(hexachlorocyclopentene) compounds of the structure:

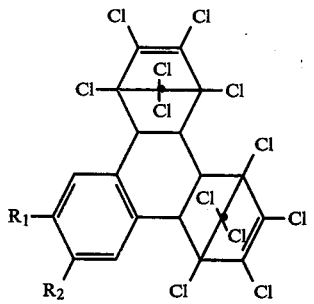

Wherein $R_1$ is $—SO_3H$ or a metal salt of $—SO_3H$; $R_2$ is hydrogen; halogen; halogen; alkyl having from 1 to 3 carbon atoms; $—NO_2$; or —COOH; and $R_1$ and $R_2$ taken together are

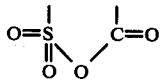

When such preferred additional chemical sensitizers are employed in heterogeneous organic photoconductive compositions comprising the present polymeric sensitizers in an acrylic binder as described herein, yet another advantage is obtained. In particular, the presence of such preferred additional chemical sensitizer appears to improve the stability of the dispersion of organic photoconductor particles by increasing the viscosity of the overall composition. With increased viscosity, the resulting composition can be coated in thicker, more uniform layers so that upon subsequent drying, the coating remains free of unacceptable flaws such as pinholes or other surface defects. That is to say, the preferred additional chemical sensitizers act in part, under these conditions, as thickening (dispersing) agents.

Further, in regard to the use of the above described preferred additional chemical sensitizer, organic sulfonic acids have been employed by others in electrophotographic elements; see U.S. Pat. No. 3,552,959 (issued Jan. 5, 1971 to K. Tubuko et al). However, when a typical organic sulfonic acid, naphthalene sulfonic acid, was incorporated into a heterogeneous organic photoconductive composition comprising one of the polymeric chemical sensitizers of this invention, no additional electrophotographic speed was observed compared to an otherwise identical composition without naphthalene sulfonic acid. The composition comprising naphthalene sulfonic acid, moreover, exhibited undesirable charge saturation when an unsuccessful attempt was made to achieve an overall surface potential of 300 V (positive polarity). The advantages obtained by employing preferred additional chemical sensitizers in combination with polymeric chemical sensitizers of this invention are accordingly quite unexpected.

Spectral sensitizers can be included in the present photoconductive insulating compositions, which are intended primarily to make the photoconductor light-sensitive to spectral regions not within the region of its inherent sensitivity. Spectral sensitizers can be chosen from a wide variety of materials known in the art. Representative spectral sensitizers which have been found useful are pyrylium dye salts inclusive of thiapyrylium and selenapyrylium dye salts such as those described in U.S. Pat. No. 3,250,615 (issued May 10, 1966 to C. C. Natali et al); the benzopyrylium type sensitizers described in U.S. Pat. No. 3,554,745 (issued Jan. 12, 1971 to J. A. Van Allan); and defensive publication T-889,023 (published Aug. 31, 1971 to G. A. Reynolds et al); or the cyanine, merocyanine or azacyanine dyes described in U.S. Pat. No. 3,597,196 (issued Aug. 3, 1971 to C. J. Fox et al).

Preferred spectral sensitizers for use with the present photoconductive compositions include the benzopyrylium dye cation 4-(thiaflavylidylmethylene) flavylium and/or the cyanine dye cation 1,3-diethyl-2-[2-(2,3,4,5-tetraphenyl-3-pyrrolyl) vinyl] -1H-imidazo-[4,5-b]quinoxalinium.

Spectral sensitizers are usually present in the composition in an amount of about 0.001% to about 0.1% by weight of the photoconductor. Wider ranges can be useful although unduly high concentrations can produce color that is apparent to the eye and change undesirably the appearance of compositions that are intended to provide a white background.

Useful binders employed in the photoconductive compositions of the invention comprise polymers having fairly high dielectric strength and which are good electrically insulating film-forming vehicles. Materials of this type comprise styrene-butadiene copolymers; silicone resins; poly(vinyl chloride); poly(vinylidene chloride); vinylidene chlorideacrylonitrile copolymers; poly(vinyl acetate); vinyl acetatevinyl chloride copolymers; poly(vinyl acetals) such as poly(vinyl butyral); polyacrylic and polymethacrylic esters such as poly(-methylmethacrylate), poly(n-butylmethacrylate), poly(isobutyl methacrylate), etc.; polystyrene; nitrated polystyrene; polymethylstyrene; isobutylene polymers; polyesters, such as poly(ethylenealkaryloxyalkylene terephthalate); phenol-formaldehyde resins; ketone resins; polyamides; polycarbonates; etc.

A preferred binder for heterogeneous compositions includes cellulose nitrate. The choice of cellulose nitrate binder is variable, and cellulose nitrates having a nitrogen content of up to about 13 percent by weight as shown by elemental analysis are preferred. Cellulose nitrate having a nitrogen content from about 11.5 to about 13 percent is especially preferred. A wide range of cellulose nitrates, at different viscosities and different nitrogen contents, is available. Many such materials are discussed in Nitrocellulose, Properties and Uses, Hercules Powder Co., (1955). The cellulose nitrate binder should be soluble in a solvent or solvent mixture that has little or no solvent action on the organic photoconductor. Alcohol soluble cellulose nitrate is preferred, such as that which exhibits appropriate solubility in lower alcohols like methanol.

Most preferred binders for heterogeneous compositions employed in the practice of the invention comprise acrylic polymers such as polyacrylates; polymethacrylates; polyalkylmethacrylates, and the like; polyalkylacrylates including polymethyl- and polyethylacrylates, and the like; polyacrylic acid; polymethacrylic acid; polyalkylacrylic acids; and polyalkylmethacrylic acids. Acrylic binders, as noted previously, are advantageous by virtue of their availability and resistance to abrasion (hardness). In addition, homopolymers comprising any of the above noted acrylic polymers, and copolymers of these acrylics with either an acrylic polymer or another type polymer can be employed. Especially preferred polymers (in contrast to the prior art relating to use of acrylic polymers with dispersed inorganic photoconductors) are copolymers of an acrylate with either acrylic or alkylacrylic acid, such as a copolymer of methylmethacrylate with either methacrylic acid or acrylic acid.

A wide range of organic photoconductors can be used in preparing the present photoconductive insulating compositions. Useful photoconductors are described by Hoegl in *The Journal of Physical Chemistry*, Vol. 69, No. 3, March 1965; organic amine photoconductors such as diarylamines and triarylamines described in Fox U.S. Pat. No. 3,597,196 issued Aug. 3, 1971; polyarylalkane photoconductors described in the aforementioned U.S. Pat. No. 3,597,196; triarylmethane leuco bases as described in Wilson U.S. Pat. No. 3,542,547 issued Nov. 24, 1970; and film-forming photoconductors such as polyvinylcarbazole. Organic photoconductors that can be provided in particulate or dissolved form are also illustrated in Volume 109 of Research Disclosure at Section IVA of Index No. 10938, pp. 62 and 63 (published May, 1973 by Industrial Opportunities, Ltd., Homewell, Havent, Hamshire, PO9 1EF, United Kingdom).

Especially useful photoconductors are microcrystalline photoconductive particles of aromatic compounds containing a plurality (i.e., 2 or more) of fused or unfused, substituted or unsubstituted aromatic rings, preferably aromatic carbocyclic rings containing 6 carbon ring atoms. In particular, microcrystalline particles of (a) fused carbocyclic ring compounds (b) polyphenyl compounds having the formula

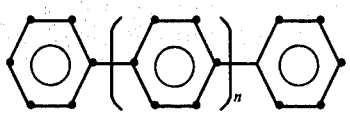

(I)

where n is an integer of from 1 to about 4; and (c) nitrogenfree, polyarylated compounds having the formula

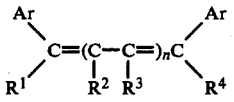

(II)

wherein n represents a number having a value of 0, 1 or 2;

Ar represents an aryl group including substituted aryl, such as phenyl, alkylphenyl having 1 to about 10 carbon atoms in the alkyl moiety (e.g., ethylphenyl, octylphenyl or tert-butylphenyl), and alkoxyphenyl having 1 to about 10 carbon atoms in the alkoxy moiety (e.g., methoxyphenyl propoxyphenyl or decoxyphenyl);

each of $R^1$, $R^2$, $R^3$ and $R^4$ represents a hydrogen atom, an aryl group (for example as defined for Ar), an alkyl group having 1 to about 10 carbon atoms, or an alkoxy group having 1 to about 10 carbon atoms. When n is 0, both $R^1$ and $R^4$ are aryl and, when both $R^1$ and $R^4$ are hydrogen, both $R^2$ and $R^3$ are aryl. Because the photoconductor in this instance is free from nitrogen atoms, it will be understood that the Ar and various R groups do not include nitrogen atoms.

Preferred fused carbocyclic ring-containing compounds (i.e., type (a) compounds noted above) for making microcrystalline photoconductive particles used in the present invention include naphthalene, anthracene, etc., preferably anthracene.

Preferred polyphenyl compounds, i.e., type (b) compounds noted, for making microcrystalline photoconductive particles include polyphenyl compounds of formula I above wherein the phenylene groups are para-phenylene groups. Such compounds include, for example, p-terphenyl, p-quaterphenyl, and p-sexiphenyl. Especially preferred materials are co-crystalline photoconductors comprising p-terphenyl doped with p-quaterphenyl. Techniques for manufacturing such especially preferred photoconductors include, for example, dissolving p-terphenyl and p-quaterphenyl in a common solvent, and thereafter co-crystallizing the dissolved polyphenyls, as described in copending application U.S. Ser. No. 800,509 entitled CO-CRYSTALLINE PHOTOCONDUCTORS AND HETEROGENEOUS COMPOSITIONS THEREOF in the name of W. E. Yoerger filed concurrently herewith.

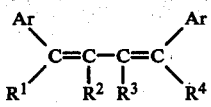

(III)

wherein each ar and $R^1$, $R^2$, $R^3$ and $R^4$ are as described above. Impurities in the photoconductor may affect its performance in compositions of the present type and usually samples of somewhat high purity are preferred. It will also be appreciated that photoconductors useful in the present invention, such as type (a), (b), and (c) compounds noted above, can include substituent groups, not specified herein, which do not impair image-forming properties of the photoconductor.

Table A lists representative photoconductors that are useful in the practice of this invention.

TABLE A

| | |
|---|---|
| Tetraphenylpyrrole | Tetraphenylethylene |
| Naphthalene | 1,4-Diphenyl-1,3-butadiene |
| Anthracene | 1,1,4-Triphenylbutadiene |
| Phenanthrene | 1,1,4,4-Tetraphenyl-1,3-butadiene |
| Pyrene | 1,2,3,4-Tetraphenyl-1,3-butadiene |
| p-Terphenyl | 1,6-Diphenyl-1,3,5-hexatriene |
| p-Quaterphenyl | Polyvinylcarbazole |
| p-Sexiphenyl | 4,4'-bis(diethylamino)-2,2'-dimethyl-triphenylmethane |

Matting agents are usefully included in the present photoconductive insulating compositions. A matting agent tends to avoid glossiness that might otherwise be obtained in layers prepared using the subject compositions and thereby enhance the "plain paper" appearance and feel that can characterize electrophotographic elements of this invention that use a paper support. Further, matting agents can improve the capability of such layers to receive legibly information written or otherwise marked on the layer. Matting agents are preferably electrically inert and hydrophobic, so as not to interfere with chargeability, charge retention or other parameters affecting electrophotographic imaging. Methacrylate and polyethylene beads are described in U.S. Pat. No. 3,810,759 (issued May 14, 1974 to T. H. Morse et al) as matting agents. Silicon containing materials are described as matting agents in U.S. Pat. No. 3,652,271 (issued March 28, 1972 to D. M. Bornarth). An especially preferred silicon based matting agent is an inorganic oxide pigment, such as fumed silicon dioxide, that has been chemically modified to render it hydrophobic by reaction with an organic compound like a silane to substitute hydrocarbylsilyl or other hydrophobic groups for the hydroxyl groups originally on the silicon dioxide chain. The fumed silica or other inorganic oxide pigment can be reacted conveniently with an appropriate silane, such as halotrialkylsilane, merely by contact in solution. A preferred silane is chlorotrimethylsilane and incorporation of the silane in an amount of about 5 to about 15% by weight of the inorganic pigment is especially desirable. It is considered that other inorganic pigments like titanium dioxide and aluminum oxide, as well as clays, could be modified similarly by reaction with a silane to provide useful matting agents. Matting agents can be employed in a wide range of particle sizes and concentrations to provide the desired degree of surface texture. It is also well known in the art to consider the thickness of the layer comprising the matting agent when selecting matting agent of a given particle size. See, for example, the aforementioned U.S. Pat. No. 3,652,271 and U.S. Pat. No. 3,519,819 issued July 7, 1970 to E. P. Gramza et al. It should be emphasized that such matting agents can be used to advantage in a wide range of homogeneous and heterogeneous photoconductive insulating compositions.

Photoconductive compositions of the invention can be prepared with the photoconducting compounds of the invention in the usual manner, i.e., by blending a dispersion or solution of a photoconductive compound together with a binder, when necessary or desirable.

In preparing the coating composition useful results are obtained where the photoconductor substance is present in an amount equal to at least about 1 weight percent of the coating composition. The upper limit in the amount of photoconductor substance present can be widely varied in accordance with usual practice. In those cases where a binder is employed, it is normally required that the photoconductor substance be present in an amount from about 1 weight percent of the coating composition to about 99 weight percent of the coating composition. A preferred weight range for the photoconductor substance in the coating composition is from about 10 weight percent to about 60 weight percent.

Heterogeneous photoconductive insulating compositions of the present invention can be prepared merely by dispersing photoconductor having the desired particle dimensions in a solution that contains a polymeric chemical sensitizer as described herein optionally a binder, and also any other constituents e.g., spectral sensitizers, matting agents, etc., to be included in the composition. The binder's solvent should not have solvent action with respect to the photoconductor, neither should the photoconductor dissolve or swell in the presence of the binder solvent. After addition of the particulate photoconductor, the heterogeneous composition is usually stirred or otherwise mixed thoroughly to assure reasonable uniformity of the dispersion. As used herein, photoconductors desirably have a maximum particle diameter ranging from about 0.1 micron to about 20 microns with from about 0.1 micron to about 10 microns being preferred. If the photoconductor has not been ball-milled or otherwise processed to an appropriate particle size prior to its dispersion in the binder, a heterogeneous composition of the invention can be prepared and thereafter agitated in the presence of stainless steel balls or other agent effective to produce a milling action that causes attrition in the particle size of the photoconductor.

In the alternative, the photoconductor can be dispersed in a non-solvent that is a solvent for both the binder (if used) and the polymeric sensitizer in accordance with the invention, and ball-milled to provide photoconductor particles for use in the present photoconductive insulating compositions. Sensitizers to be included in the composition can be added to the photoconductor dispersion prior to such ball-milling. After this first ball-milling stage, the present polymeric sensitizer and binder can be added. The composition is preferably again milled to obtain a uniform dispersion.

If the polymeric sensitizers of the invention are employed also as binder for heterogeneous photoconductive compositions, then any of the foregoing formulating techniques are equally applicable.

In the present heterogeneous compositions, the photoconductor is desirably included in an amount of at least about 40% by weight of solids in the composition and may range to 95 weight percent and higher depending on the particular application. Generally, the binder need only be present in an amount sufficient to provide adhesion between particles in the composition and between the composition and the support, if used. In various preferred embodiments, the photoconductor and any sensitizers, matte agents or other adjuvants constitute between about 70 and 90%, by weight, of solids in the composition, with the binder or binders making up the remainder of the composition. In certain instances, photoconductive speed of heterogeneous compositions may diminish with photoconductor concentrations of less than about 60 weight percent.

As indicated above, the photoconductive insulating composition is usually prepared as a solution of the binder containing other components of the composition including dispersed or dissolved photoconductive materials. In such form, the composition can be formed into a self-supporting member or it can be coated on an electrically conducting support to provide an electrophotographic element. For purposes of coating, the compositions desirably range from about 20 weight percent solids to about 40 weight percent solids. If extrusion hopper coating is to be used, the most useful solids content of the composition is usually between about 20 and 30 weight percent. For doctor blade coating, from about 30 to about 40 weight percent solids is preferred. Wider ranges may be appropriate depending on conditions of use. In preparing heterogeneous compositions for purposes such as ball milling and coating, it may be desirable to use a solvent blend to provide optimal viscosity, ease of solvent removal or the like.

Acetonitrile, moreover, can be desirable in combination with methanol to provide a solvent mixture for the cellulose nitrate binders discussed herein.

In applying the photoconductive insulating compositions on a surface or support, they are usually coated by any suitable means, such as extrusion hopper, doctor blade or whirler coating apparatus, at a coverage sufficient to provide a layer of from 10 to about 25 microns thick when dry, although wider variations may be useful. In the case of heterogeneous compositions, the dry thickness for any given wet thickness as coated will depend in part on the size of the photoconductive particles in the composition and on the amount of void volume, if any, in the layer. Coverages of from about 2 to about 15 grams per square meter of support are often used.

Suitable supporting materials on which can be coated photoconductive layers comprising the photoconductive compositions described herein include any of a wide variety of electrically conducting supports, for example, paper (at a relative humidity above 20 percent); aluminum-paper laminates; metal foils such as aluminum foil, zinc foil, etc.; metal plates, such as aluminum, copper, zinc, brass and galvanized plates; vapor deposited metal layers such as silver, nickel, aluminum; electrically conducting metals intermixed with SiO (as described in U.S. Pat. No. 3,880,657 issued Apr. 29, 1975 to A. A. Rasch) and the like coated on paper or conventional photographic film bases such as cellulose acetate, polystyrene, polyester, etc. Such conducting materials as nickel can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without insulating barrier layers are described in U.S. Pat. No. 3,245,833 by Trevoy, issued Apr. 12, 1966. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. No. 3,007,901 by Minsk, issued Nov. 7, 1961 and 3,262,807 by Sterman et al, issued July 26, 1966. Another useful support is paper or other fibrous material having thereon, to enhance electrical properties of the support, an electrically conducting material as described in U.S. Pat. No. 3,814,599 (issued June 4, 1974 to D. A. Cree), particularly in Columns 2 and 3 of the patent.

Photoconductive compositions according to the present invention can be employed in electrophotographic elements useful in any of the well known electrophotographic processes which require photoconductive layers. One such process is the xerographic process. In a process of this type, an electrophotographic element is held in the dark and given a blanket electrostatic charge by placing it under a corona discharge. This uniform charge is retained by the layer because of the substantial dark insulating property of the layer, i.e., the low conductivity of the layer in the dark. The electrostatic charge formed on the surface of the photoconductive layer is then selectively dissipated from the surface of the layer by imagewise exposure to light by means of a conventional exposure operation such as, for example, by a contact printing technique, or by lens projection of an image, and the like, to thereby form a latent electrostatic image in the photoconductive layer. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically responsive particles having optical density. The developing electrostatically responsive particles can be in the form of a dust, i.e., powder, or a pigment in a resinous carrier, i.e., toner. A preferred method of applying such toner to a latent electrostatic image for solid area development is by the use of a magnetic brush. Methods of forming and using a magnetic bursh, toner applicator are described in the following U.S. Pat. Nos. 2,786,439 by Young, issued Mar. 26, 1957; 2,786,440 by Giaimo, issued Mar. 26, 1957; 2,786,441 by Young, issued Mar. 26, 1957; 2,874,063 by Greig, issued Feb. 17, 1959. Liquid development of the latent electrostatic image may also be used. In liquid development, the developing particles are carried to the image-bearing surface in an electrically insulating liquid carrier. Methods of development of this type are widely known and have been described in the patent literature, for example, U.S. Pat. No. 2,907,674 by Metcalfe et al, issued Oct. 6, 1959. In dry developing processes, the most widely used method of obtaining a permanent record is achieved by selecting a developing particle which has as one of its components a low-melting resin. Heating the powder image then causes the resin to melt or fuse into or on the element. The powder is therefore caused to adhere permanently to the surface of the photoconductive layer. In other cases, a transfer of the electrostatic charge image formed on the photoconductive layer can be made to a second support such as paper which would then become the final print after development and fusing. Techniques of the type indicated are well known in the art and have been described in the literature such as in "RCA Review," Volume 15 (1954), pages 469–484.

Because the electrophotographic elements described herein can be developed in a liquid environment, as above described, the non-photoconductive surface of the element, i.e., that side of the support opposite the side carrying the photoconductive layer, can be overcoated with a so-called solvent hold-out layer. One or more of these layers serve to reduce or eliminate penetration of solvent or liquid carriers into the paper support during development. A typical solvent hold-out layer can include pigments, pigment dispersing agents, clays, latices such as styrene-butadiene latex, polyvinylalcohol, and the like, in various proportions to give the desired result.

H and D electrical speeds to indicate the photoconductive response of electrophotographic materials such as those discussed herein can be determined as follows: The material is electrostatically charged under, for example, a corona source until the surface potential, as measured by an electrometer probe, reaches some suitable initial value $V_o$, typically from 100 to about 600 volts. The charged element is then exposed to a 3000°

K. tungsten light source or a 5750° Xenon light source through a stepped density gray scale. The exposure causes reduction of the surface potential of the element under each step of the gray scale from its initial potential $V_o$ to some lower potential V the exact value of which depends upon the amount of exposure in meter-candle-seconds received by the area. The results of these measurements are then plotted on a graph of surface potential V vs. log exposure for each step, thereby forming an electrical characteristic curve. The electrical or electrophotographic speed of the photoconductive composition can then be expressed in terms of the reciprocal of the exposure (in meter-candle-seconds) required to reduce the initial surface potential to any fixed selected value, typically ½ Vo or 100 volts below Vo (100 volt shoulder electrical speed). The foregoing procedure was employed in the examples below. An apparatus useful for determining the electrophotographic speeds of photoconductive compositions is described in Robinson et al, U.S. Pat. No. 3,449,658, issued June 10, 1969.

The following Examples are included to illustrate the present invention:

EXAMPLES 1-5

Photoconductive insulating compositions consisting of 3 g. p-terphenyl, 1.07 g. cellulose nitrate (grade RS ½ sec supplied as 70 percent solids in isopropanol by Hercules Powder Company), 30 mg. chemical sensitizer as shown in Table I and 12 ml. of a dye solution consisting of 0.003 g. of 4-(thiaflavylidylmethylene) flavylium chloride in 120 ml. of methanol (spectral sensitizing dye) were placed in 50 ml. vials containing 30 g. of 2.5 mm zirconium oxide milling media and milled for 2 hours by being shaken on a reciprocating paint shaker. The resultant compositions were each coated at a wet thickness of about 0.1 mm on a polyester support bearing a conducting layer of vacuum deposited nickel and dried to prepare electrophotographic elements. An otherwise identical control element without chemical sensitizer was prepared in the same manner. Each of the electrophotographic elements was charged to 300 volts (positive polarity) and thereafter exposed to a 3000° K. tungsten light source for a time sufficient to discharge exposed regions to +150 volts. With the electrical speed of the control element arbitrarily designated 100, the speeds of the chemically sensitized elements relative to the control were as shown in Table I.

TABLE I

| Example | Chemical Sensitizer | Relative Electrical Speed |
|---|---|---|
| | None (control) | 100 |
| 1 | polyvinylchlorendate (39.6% Cl)[1] | 145 |
| 2 | polyvinylchlorendate (46.5% Cl)[2] | 190 |
| 3 | polyvinylchlorendate (50.6% Cl)[3] | 195 |
| 4 | polyvinylchlorendate (51.2%Cl)[4] | 195 |
| 5 | poly(vinylchlorendate-co-vinylacetate)[5] | 185 |

1 % Cl represents about 25 percent vinyl alcohol repeating units converted to vinylchlorendate
2 50% conversion to vinylchlorendate
3 87% conversion to vinylchlorendate
4 100% conversion to vinylchlorendate
5 molar ratio of about 1 vinylchlorendate to 1 vinylacetate

EXAMPLES 6-10

Photoconductive insulating compositions consisting of 3 g. p-terphenyl; 0.75 g. of either polyisobutylmethacrylate (sold by E. I. DuPont de Nemours and Company under the tradename Elvacite 2045) or poly(methylmethacrylate-co-methacrylic acid 75/25) as binder; 1 percent, 2 percent or 3 percent polyvinylchlorendate chemical sensitizer; and 12.4 ml. of a solvent containing 0.0003 g. of spectral sensitizer, were milled, shaken, and coated on a nickelized support. The electrical speeds of the resulting electrophotographic elements were determined relative to the electrical speed of the control of Examples 1-5. Results are tabulated in Table II.

TABLE II

| Example | Binder | Chemical Sensitizer (percent) | Relative Electrical Speed |
|---|---|---|---|
| | cellulose nitrate (control) | 0 | 100 |
| 6 | poly(isobutylmethacrylate) | 0 | <1 |
| 7 | poly(isobutylmethacrylate) | polyvinylchlorendate (1%) | 171 |
| 8 | poly(isobutylmethacrylate) | polyvinylchlorendate (2%) | 190 |
| 9 | poly(methylmethacrylate-co-methacrylic acid 75/25*) | 0 | <1 |
| 10 | poly(methylmethacrylate-co-methacrylic acid 75/25*) | polyvinylchlorendate (3%) | 300 |

*The designation 75/25, and similiar designation employed herein signify the molar ratio of the monomers in the polymer named, in order of their appearance in the polymer name.

EXAMPLES 11-20

Photoconductive insulating compositions were prepared in the manner of examples 1-5 using cellulose nitrate binder except that the polymeric vinylchlorendate chemical sensitizer was replaced with 1 percent of the chemical sensitizer shown in Table III below. A second set of photoconductive insulating compositions was prepared in the manner of examples 9 and 10 using poly(methylmethacrylate-co-methacrylic acid 75/25) binder except that the polymeric vinylchlorendate chemical sensitizer was replaced with 3 percent of the chemical sensitizer as shown in Table III. The compositions were milled, shaken, and coated on respective nickelized supports. The electrical speeds of the resulting elements were determined relative to the cellulose nitrate control of examples 1-5. Results are tabulated in Table III.

TABLE III

| Example | Chemical Sensitizers | Relative Electrical Speed: Poly(methylmethacrylate-co-methacrylic acid 75/25) | Relative Electrical Speed: Cellulose Nitrate Binder |
|---|---|---|---|
| | None | <1 | 100 (control) |
| 11 | Cellulose acetic butyrate chlorendate | 90 | 105 |
| 12 | Cellulose acetate chlorendate | 110 | 150 |
| 13 | Diethyleneglycol chlorendate alkyd resin | 30 | 125 |
| 14 | Ethyleneglycol chlorendate alkyd resin | 85 | 130 |
| 15 | Polyvinylbutyral chlorendate | 95 | 110 |
| 16 | Methylcellulose chlorendate | 90 | —* |
| 17 | Poly(methylmethacrylate-co-2-methacryloyloxyethyl chlorendate 70/30) | 85 | 170 |
| 18 | Poly(vinylchloroendate-co-vinyl alcohol 50/50) | 160 | —* |
| 19 | Poly(vinylchlorendate-co-vinyl acetate 50/50) | 130 | —* |
| 20 | Poly(vinylchlorendate-co-vinyl chlorendate-N-phenylamide) | 90 | —* |

*Not determined

In evaluations similar to those of examples 11–20, homopolymers of 2-methacryloyloxyethylchlorendate were found useful as chemical sensitizers for photoconductive compositions of p-terphenyl particles dispersed in the acrylic binder of examples 11–20.

EXAMPLE 21

Electrophotographic elements were prepared from photoconductive compositions consisting of anthracene, p-terphenyl or p-quaterphenyl photoconductor dispersed in poly(vinyl butyral); silicon resin; urethane resin; alcohol soluble cellulose propionate; alcohol soluble cellulose acetate butyrate; poly(vinyl acetate-co-crotonic acid); a vinyl resin sold by Monsanto under the Tradename Multipolymer R.P. 1714; or a vinyl polymer sold by Monsanto under the tradename Gelva R.P.—606, as binder. Polyvinylchlorendate and the spectral sensitizer of the previous examples were employed. In each instance, it can be expected that the relative electrical speed of each prepared element compared against an unsensitized control will indicate useful chemical sensitization employing a polymeric sensitizer in accordance with the invention.

EXAMPLE 22

Photoconductive compositions containing either p-terphenyl or anthracene dispersed in any one of several polymeric binder-sensitizers in accordance with the invention were prepared in an approximate ratio by weight of 4:1 photoconductor to binder-sensitizer, and the resulting compositions used to prepare electrophotographic elements in the manner described in the preceding examples. Specific compositions included p-terphenyl dispersed in polyvinyl chlorendate; p-terphenyl dispersed in cellulose acetate chlorendate; p-terphenyl dispersed in cellulose acetate butyrate chlorendate; anthracene dispersed in polyvinylchlorendate-N-phenylamide; anthracene dispersed in polyvinylchlorendate methyl ester; p-terphenyl dispersed in a copolymer of methylmethacrylate and 2-methacryloyloxyethylchlorendate (70/30); p-terphenyl dispersed in various terpolymers of methylmethacrylate, methacrylic acid, and 2-methacryloyloxyethylchlorendate; and p-terphenyl dispersed in a homopolymer of 2-methacryloyloxyethylchlorendate. Relative electrical speed of each prepared element compared to a control element confirmed that the above polymeric sensitizers can serve simultaneously as binder. (An element having a composition including anthracene dispersed in polyvinylchlorendate experienced charge saturation during relative electrical speed evaluation. It is believed that such charge saturation was due to the stainless steel milling media employed in the preparation of that composition. An element prepared from a similar composition employing in its preparation a zirconium oxide milling media, was not subject to this problem.)

EXAMPLES 23–51

The following examples illustrate the benefit of employing polymeric sensitizers of the invention with an acrylic polymer binder (homo-, and copolymers) including an acrylic polymer binder having acid groups.

Photoconductive compositions were prepared using an acrylic polymer binder and 1 percent polyvinylchlorendate, 0.01 percent of the spectral sensitizing dye of examples 1–5, and p-terphenyl photoconductor. The resulting compositions were used to make electrophotographic elements and evaluated for relative electrical speed against a chemically sensitized control element containing a polymethylmethacrylate binder and assigned an electrical speed of 100. Results are shown in Table IV.

TABLE IV

| Example | Binder | Relative Electrical Speed |
|---|---|---|
| 23 | polymethylmethacrylate (control) | 100 |
| 24 | poly(methylacrylate-co-acrylic acid 70/30) | 280 |
| 24 | poly(methylmethacrylate-co-2-hydroxyethyl acrylate 95/5) | 110 |
| 26 | poly(methylmethacrylate-co-n-butylmethacrylate) Sold under the tradename Elvacite 2013 by | |

TABLE IV-continued

| Example | Binder | Relative Electrical Speed |
|---|---|---|
| | E. I. DuPont de Nemours | 230 |
| 27 | poly(methylmethacrylate-co-acrylic acid 80/20) | 260 |
| 28 | poly(methylmethacrylate-co-methacrylic acid 80/20) | 320 |
| 29 | poly(methylmethacrylate-co-methacrylic acid 75/25) | 330 |
| 30 | poly(methylmethacrylate-co-methacrylic acid 70/30) | 360 |
| 31 | polyethylmethacrylate | 260 |
| 32 | poly(ethylmethacrylate-co-methacrylic acid 73/27) | 320 |
| 33 | poly(n-butylacrylate-co-styrene-co-acrylic acid 59/25/16) | 230 |
| 34 | poly(n-butylmethacrylate) | 290 |
| 35 | poly(n-butylmethacrylate-co-methacrylic acid 90/10) | 380 |
| 36 | poly(n-butylmethacrylate-co-methacrylic acid 81/19) | 400 |
| 37 | poly(n-butylmethacrylate-co-methacrylic acid 71/29) | 480 |
| 38 | poly(n-butylmethacrylate-co-methacrylonitrile 68/32) | 330 |
| 39 | poly(n-butylmethacrylate-co-methacrylonitrile-co-methacrylic acid 68/16/16) | 370 |
| 40 | poly(n-butylmethacrylate-co-isobutylmethacrylate 50/50) | 380 |
| 41 | poly(isobutylmethacrylate) | 360 |
| 42 | poly(isobutylmethacrylate-co-methacrylic acid 80/20) | 400 |
| 43 | poly(isobutylmethacrylate-co-styrene 75/25) | 280 |
| 44 | poly(t-butylmethacrylate) | 300 |
| 45 | poly(t-butylmethacrylate-co-methacrylic acid 77/23) | 320 |
| 46 | poly(t-butylmethacrylate-co-vinylbutylether-co-methacrylic acid 44/30/26) | 360 |
| 47 | poly(2-ethylhexyl acrylate-co-methacrylic acid 68/32) | 340 |
| 48 | poly(2-ethylhexyl methacrylate-co-methacrylic acid 70/30) | 320 |
| 49 | poly(2-chloroethylmethacrylate-co-methacrylic acid 78/22) | 360 |
| 50 | poly(propylmethacrylate-co-methacrylic acid 75/25) | 230 |
| 51 | poly(vinylacetate-co-methylmethacrylate-co-methacrylic acid 63/27/10) | 220 |

Useful relative electrical speeds were also observed in above examples 29–41 when polyvinylchlorendate chemical sensitizer was present in the composition at 2 percent and 3 percent loading (by weight based on p-terphenyl.

EXAMPLE 52

Electrophotographic elements were prepared as in preceding examples 29–41, employing polyvinyl chlorendate and compared against otherwise identical elements containing any one of 2,3,6-trichloroquinoxaline; 2,3,6,7-tetrachloroquinoxaline; 1,5-naphthalene disulfonyl fluoride; chlorendic acid; chlorendic anhydride; tetrachlorophthalic anhydride; tetracyanopyrazine; poly(vinyltrifluoroacetate); trichloroacetic acid; hexafluorobutyric acid; and poly(styrene sulfonic acid). Elements containing these compounds exhibited little or no increase in electrical speed relative to otherwise identical control elements having no chemical sensitizing addenda. Elements containing polyvinylchlorendate registered, on the other hand, an increase of about 180 in electrical speed relative to the same controls.

EXAMPLES 53–59

Two sets of electrophotographic elements were prepared as in preceding example 29. In the first set, 1 percent of the compound indicated in Table V was added. The second set of prepared elements was identical to the first set except that 3 percent polyvinylchlorendate was also added. Elements in both sets were evaluated for relative electrical speed as in the preceding examples against an otherwise identical control having no chemical sensitizer. An additional element containing 3 percent polyvinylchlorendate added to the composition of the control was also prepared. Results are shown in Table V.

TABLE V

| Example | Chemical Sensitizer | Relative Electrical Speed |
|---|---|---|
| | None (control) | 1 |
| 53 | 2,3,6-trichloroquinoxaline | 1 |
| 54 | 2,3,6,7-tetrachloroquinoxaline | 4 |
| 55 | 2-naphthalene sulfonic acid-Bis(hexachlorocyclopentadiene) Diels Alder adduct | 12 |
| 56 | control + 3% polyvinylchlorendate | 260 |
| 57 | same as Ex. 53 + 3% polyvinylchlorendate | 360 |
| 58 | same as Ex. 54 + 3% polyvinylchlorendate | 350 |
| 59 | same as Ex. 55 + 3% polyvinylchlorendate | 360 |

EXAMPLES 60–65

To a homogeneous photoconductive composition comprising polyvinylcarbazole photoconductor was added 2 percent (by weight based on photoconductor) chlorendic acid or 2 percent polyvinylchlorendate. The resulting compositions were coated on electrically conducting supports to form respective elements and then evaluated for +100 volt shoulder relative electrical speed against an otherwise identical control element without additive. The speed of the control element was arbitrarily assigned a value of 100 as in previous examples.

A homogeneous photoconductive composition comprising 40 percent (by weight based on total composition) 4,4'-bis(diethylamino)-2,2'-dimethyl-triphenylmethane photoconductor, 60 percent (by weight based on total composition) poly(isopropylidene-bisphenoxyethyl-co-ethylene terephthalate 50/50) as binder, and 1 percent (by weight based on photoconductor) 2,4-bis(4-ethoxyphenyl)-6-(4-amyloxystyryl) pyrylium fluoroborate as spectral sensitizing dye was formulated. To individual portions of the composition was added 1 percent or 2 percent (by weight based on photoconductor) polyvinylchlorendate. Composition without polyvinylchlorendate was designated control. The resulting compositions were coated and evaluated as in the polyvinylcarbazole compositions described above.

Results are shown in Table VI below:

TABLE VI

| Example | Photoconductor | Chemical Sensitizer | 100 Volt Shoulder Relative Electrical Speed |
|---|---|---|---|
| 60 | polyvinylcarbazole | 0 (control) | 100 |
| 61 | polyvinylcarbazole | 2% chlorendic acid | 91.7 |
| 62 | polyvinylcarbazole | 2% polyvinylchlorendate | 750 |
| 63 | 4,4'-bis(diethylamino)-2,2'-dimethyl-triphenylmethane | 0 (control) | 100 |
| 64 | 4,4'-bis(diethylamino)-2,2'-dimethyl-triphenylmethane | 1% polyvinylchlorendate | 116 |
| 65 | 4,4'-bis(diethylamino)-2,2'-dimethyl-triphenylmethane | 2% polyvinylchlorendate | 126 |

Discussion of Examples

Examples 1–5 illustrate among other things the chemical sensitization of heterogeneous photoconductive insulating compositions comprising particles of an organic photoconductor dispersed in an electrically insulating binder with a polymeric chemical sensitizer in accordance with the invention.

Examples 6–10 exemplify in part the use of a polymeric chemical sensitizer according to the invention both with other binders and in varying concentrations.

Examples 11–20 illustrate among other things various polymeric backbones, including homopolymers, copolymers, etc., to which the appropriate radicals in accordance with the invention can be appended. Other backbones would be expected to give similar results.

Example 21 illustrates in part the operability of the present polymeric chemical sensitizers with any one of a variety of organic photoconductors dispersed in any one of a variety of well known binders.

Example 22 exemplifies in part the use of the present polymeric chemical sensitizers as both sensitizer and binder.

Examples 23–51 illustrate among other things the preferred use of polymeric sensitizers of the invention with acrylic binders including acrylic homopolymers, acrylic copolymers, and acrylic polymers containing acid groups. This is to be contrasted with a prior art bias existing against the use of such binders with dispersions of inorganic photoconductors.

Example 52 illustrates among other things several aspects of the invention. The importance of attaching chlorendate groups to a polymer backbone is pointed out by the comparison of the relative electrical speed of polyvinylchlorendate with either chlorendic anhydride or chlorendic acid. The other compounds against which the present polymeric sensitizers are compared have been known to be useful as chemical sensitizers either in homogeneous systems or systems in which chemical sensitization is otherwise binder dependent.

Examples 53–59 illustrate in part that despite the relative inability of certain compounds to chemically sensitize heterogeneous organic photocnductive compositions, in the presence of the present polymeric sensitizers, such compounds contribute, often synergistically, to the overall electrical speed of the composition.

Examples 60–65 illustrate among other things the unexpected utility of the polymeric chemical sensitizers of the invention in homogeneous photoconductive insulating compositions. While compounds similar to the chlorendate radical, such as chlorendic acid in example 61, appear unable to serve as chemical sensitizer in homogeneous compositions, the corresponding polymer with monovalent chlorendate radicals is highly useful in this regard.

The invention has been described in detail with particular reference to preferred embodiments thereof, but it will be understood that variations and modifications can be effected within the spirit and scope of the invention as described hereinabove and as defined in the appended claims.

What is claimed is:

1. A photoconductive insulating composition comprising an organic photoconductor chemically sensitized with a polymer comprising repeating units to which are appended a monovalent chlorendate radical.

2. A homogeneous photoconductive insulating composition comprising an organic photoconductor chemically sensitized with a polymer comprising repeating vinyl, acrylic, or cellulose units to which are appended a monovalent chlorendate radical.

3. A composition as described in claim 2 wherein said organic photoconductor is a polyvinylcarbazole or triarylalkane.

4. A composition as described in claim 2 wherein said organic photoconductor is polyvinylcarbazole or 4,4'-bis(diethylamino)-2,2'-dimethyl-triphenylmethane, and said polymer is polyvinylchlorendate.

5. A heterogeneous photoconductive insulating composition comprising particles of an organic photoconductor chemically sensitized with a polymer comprising repeating units to which are appended a monovalent chlorendate radical.

6. A composition as described in claim 5 wherein said polymer is a vinyl, acrylic, or cellulose polymer.

7. A composition as described in claim 5 wherein said polymer is polyvinyl chlorendate; cellulose acetate butyrate chlorendate; diethyleneglycol chlorendate alkyd resin; ethyleneglycol chlorendate alkyd resin; polyvinylbutyral chlorendate; methylcellulose chlorendate; poly(methylmethacrylate-co-2-methacryloyloxyethyl chlorendate); poly(vinylchlorendate-co-vinyl alcohol); poly(vinylchlorendate-co-vinyl acetate); poly(vinylchlorendate-co-vinyl chlorendate-N-phenylamide); or poly(2-methacryloyloxyethyl chlorendate).

8. A composition as described in claim 5 wherein said polymer is polyvinyl chlorendate.

9. A heterogeneous photoconductive insulating composition comprising particles of an organic photoconductor chemically sensitized with a polymer comprising repeating units to which are appended a monovalent chlorendate radical and further comprising, in addition to said polymer, an electrically insulating binder in which said photoconductor particles are dispersed.

10. A composition as described in claim 9 wherein said electrically insulating binder is cellulose nitrate having a nitrogen content from about 11.5 to about 13 percent.

11. A composition as described in claim 10 wherein said composition additionally comprises a cyanine or benzopyrylium spectral sensitizer.

12. A composition as described in claim 11 wherein said organic photoconductor comprises p-terphenyl, said polymer is polyvinyl chlorendate, said cyanine spectral sensitizer is a 1,3-diethyl-2-{-(2,3,4,5-tetraphenyl-3-pyrrolyl)vinyl}-1H-imidazo{4,5-b} quinoxalinium salt, and said benzo pyrylium spectral sensitizer is a 4-(thiaflavylidylmethylene)flavylium salt.

13. A composition as described in claim 9 wherein said organic photoconductor comprises p-terphenyl, p-quaterphenyl or anthracene, and said binder is a polymer of acrylic acid or methacrylic acid.

14. A composition as described in claim 9 wherein said electrically insulating binder is a polymer of acrylic acid, methacrylic acid, an acrylic ester or a methacrylic ester.

15. A composition as described in claim 14 wherein said composition additionally comprises a cyanine or benzopyrylium spectral sensitizer.

16. A composition as described in claim 15 wherein said organic photoconductor comprises p-terphenyl, said sensitizing polymer is polyvinylchlorendate, said cyanine spectral sensitizer is a 1,3-diethyl-2-{-(2,3,4,5-tetraphenyl-3-pyrrolyl)vinyl}-1H-imidazo{4,5-b}quinoxalinium salt, and said benzopyrylium spectral sensitizer is a 4-(thiaflavylidylmethylene)flavylium salt.

17. A composition as described in claim 14 wherein said binder is poly(methylmethacrylate-co-methacrylic acid); poly(n-butylmethacrylate-co-methacrylic acid); poly(n-butylmethacrylate-co-methacrylonitrile); poly(n-butylmethacrylate-co-methacrylonitrile-co-methacrylic acid); poly(i-butylmethacrylate-co-methacrylonitrile-co-methacrylic acid); poly(i-butylmethacrylate); poly(n-butylmethacrylate-co-i-butylmethacrylate); poly(i-butylmethacrylate); poly(i-butylmethacrylate-co-methacrylic acid); poly(t-butylmethacrylate); poly(t-butylmethacrylate-co-methacrylic acid); poly(t-butylmethacrylate-co-vinylbutylether-co-methacrylic acid); poly(2-ethylhexylacrylate-co-methacrylic acid); poly(2-ethylhexylmethacrylate-co-methacrylic acid); or poly(2-chloroethylmethacrylate-co-methacrylic acid).

18. A heterogeneous photoconductive insulating composition comprising particles of an organic photoconductor chemically sensitized with polyvinylchlorendate and further comprising, in addition to said polyvinylchlorendate, an electrically insulating binder in which said photoconductor particles are dispersed.

19. A composition as described in claim 18 wherein said polyvinyl chlorendate is present in said composition in an amount from about 0.5 to about 10 percent, by weight, of said photoconductor.

20. A composition as described in claim 18 wherein said polyvinyl chlorendate is present in said composition in an amount from about 1 to about 3 percent, by weight, of said photoconductor.

21. A heterogeneous photoconductive insulating composition comprising particles of an organic photoconductor chemically sensitized with both a sensitizing polymer comprising repeating units to which are appended a monovalent chlorendate radical, and a second chemical sensitizer, and further comprising, in addition to said sensitizing polymer and second chemical sensitizer, an electrically insulating binder in which said photoconductor particles are dispersed.

22. A composition as described in claim 21 wherein said sensitizing polymer is polyvinyl chlorendate, and said second chemical sensitizer is a trichloroquinoxaline or a tetrachloroquinoxaline.

23. A composition as decribed in claim 21 wherein said electrically insulating binder is a polymer of acrylic acid, methacrylic acid, an acrylic ester, or a methacrylic ester, said sensitizing polymer is polyvinyl chlorendate, and said additional chemical sensitizer has the structure:

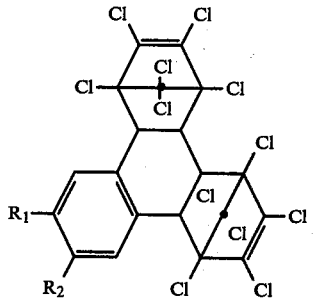

wherein $R_1$ is $—SO_3H$ or a metal salt of $—SO_3H$;

$R_2$ is hydrogen; halogen; alkyl having 1 to 3 carbon atoms;

$—NO_2$; or —COOH; and $R_1$ and $R_2$ taken together are

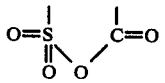

24. A composition as described in claim 23 wherein said composition additionally comprises a cyanine or benzopyrylium spectral sensitizer.

25. A composition as described in claim 23 wherein organic photoconductor comprises p-terphenyl, said cyanine spectral sensitizer is a 1,3-diethyl-2-{2-(2,3,4,5-tetraphenyl-3-pyrrolyl)vinyl}-1H-imidazo{4,5-b} quinoxalinium salt and said benzopyrylium spectral sensitizer is a 4-(thiaflavylidylmethylene)flavylium salt.

26. A composition as described in claim 23 wherein said photoconductor is p-terphenyl, and said electrically insulating binder comprises a copolymer of methylmethacrylate with methacrylic acid.

27. A heterogeneous photoconductive insulating composition comprising particles of an organic photoconductor dispersed in and chemically sensitized by an electrically insulating polymer comprising repeating units to which are appended a monovalent chlorendate radical.

28. A composition as described in claim 27 wherein said polymer is a vinyl, acrylic or cellulose polymer.

29. A composition as described in claim 27 wherein said polymer comprises vinyl chlorendate or 2-methacryloyloxyethyl chlorendate.

30. An electrophotographic element comprising an electrically conducting support bearing thereon a layer of a photoconductive insulating composition comprising an organic photoconductor chemically sensitized with a polymer comprising repeating units to which are appended a monovalent chlorendate radical.

31. An electrophotographic element as described in claim 24 wherein said polymer is a vinyl, acrylic, or cellulose polymer.

32. An electrophotographic element as described in claim 31 wherein said photoconductor is anthracene, p-terphenyl, p-quaterphenyl, polyvinylcarbazole, or 4,4'-bis(diethylamino)-2,2'-dimethyl-triphenylmethane.

33. An electrophotographic element comprising an electrically conducting paper support bearing thereon a layer of a heterogeneous photoconductive insulating composition comprising particles of p-terphenyl chemically sensitized with polyvinyl chlorendate and further comprising, in addition to said polyvinylchlorendate, an electrically insulating polymer in which said p-terphenyl particles are dispersed.

34. An electrophotographic element as described in claim 33 wherein said binder is a polymer of acrylic acid, methacrylic acid, an acrylic ester, or a methacrylic ester.

35. An electrophotographic element as described in claim 34 wherein said binder is a copolymer of methylmethacrylate with methacrylic acid, and said composition additionally comprises both a matte agent and an additional chemical sensitizer which is 3-methyl-2-naphthalene sulfonic acid-bis(hexachlorocyclopentadiene) adduct.

36. An electrophotographic process comprising applying a uniform charge to the surface of an electrophotographic element, imagewise exposing said charged surface to actinic radiation to form an electrostatic latent image, and developing said latent image to form a visible image, said electrophotographic element being an element as defined in claim 30.

37. An electrophotographic process comprising applying a uniform charge to the surface of an electrophotographic element, imagewise exposing said charged surface to actinic radiation to form an electrostatic latent image, and developing said latent image to form a visible image, said electrophotographic element being an element as defined in claim 35.

38. An electrophotographic copy comprising an element as defined in claim 30 and a visible image pattern on said photoconductive insulating composition layer.

* * * * *

UNITED STATES PATENT AND TRADEMARK OFFICE

CERTIFICATE OF CORRECTION

PATENT NO. : 4,160,666
DATED : July 10, 1979
INVENTOR(S) : John M. McCabe et al.

It is certified that error appears in the above—identified patent and that said Letters Patent is hereby corrected as shown below:

Column 25, line 4, Claim 31, line 2, "24" should read -- 30 --.

Signed and Sealed this

*Third* Day of *March 1981*

[SEAL]

*Attest:*

RENE D. TEGTMEYER

*Attesting Officer*

*Acting Commissioner of Patents and Trademarks*